US006443749B2

(12) United States Patent
Brownell et al.

(10) Patent No.: US 6,443,749 B2
(45) **Date of Patent: *Sep. 3, 2002**

(54) FIXED POSITION ZIF (ZERO INSERTION FORCE) SOCKET SYSTEM

(75) Inventors: Michael P. Brownell, Los Gatos; Jim Maveety, San Jose, both of CA (US)

(73) Assignee: Intel Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/537,059

(22) Filed: Mar. 28, 2000

(51) Int. Cl.[7] ..... H01R 11/22
(52) U.S. Cl. ..... 439/268; 439/851
(58) Field of Search ..... 439/941, 266, 439/268, 159, 259, 839, 851

(56) References Cited

U.S. PATENT DOCUMENTS 3,727,173 A * 4/1973 Goldmann et al. ..... 439/267
3,922,057 A * 11/1975 Lemke et al. ..... 439/844
4,083,623 A * 4/1978 Lynch ..... 439/741
4,236,525 A * 12/1980 Sluetz et al. ..... 128/419 P
4,468,073 A * 8/1984 Machcinski ..... 439/266
4,540,236 A * 9/1985 Peers-Trevarton ..... 439/159
4,734,047 A * 3/1988 Krumme ..... 439/161
4,781,602 A * 11/1988 Cobaugh ..... 439/82
5,342,213 A * 8/1994 Kobayashi ..... 439/268
5,439,393 A * 8/1995 Watson ..... 439/578
5,454,726 A * 10/1995 Lee et al. ..... 439/65
6,022,236 A * 2/2000 McHugh et al. ..... 439/342
6,042,409 A * 3/2000 Ohshima ..... 439/268

* cited by examiner

*Primary Examiner*—Gary F. Paumen
*Assistant Examiner*—James R. Harvey
(74) *Attorney, Agent, or Firm*—Schwegman, Lundberg, Woessner & Kluth, P.A.

(57) ABSTRACT

An electrical socket connection for coupling a conductive pin to a circuit board. The socket has several contact points that can be expanded to create an opening sufficiently sized to allow the conductive pin to pass through the contact points with minimal insertion force. After the pin is inserted, the contact points can be retracted to form electrical interconnects with the pin. The contacts are electrically coupled to the remaining circuitry via the socket. The present invention, therefore, provides a zero insertion force socket that has multiple contact points and does not require secondary movement of the pin or circuit package.

36 Claims, 12 Drawing Sheets

FIXED POSITION ZIF (ZERO INSERTION FORCE) SOCKET SYSTEM

FIELD OF THE INVENTION

The present invention relates to the field of connectors used for electrical interconnects. More particularly, this invention relates to a fixed position zero insertion force socket system.

BACKGROUND OF THE INVENTION

Conductive pins can be used to interconnect a circuit package with a circuit board. Zero Insertion Force (ZIF) sockets, as the name implies, requires zero insertion force to insert a pin into the socket. Some ZIF sockets move the pin or the package to a contact or the contact is moved to the pin.

Some ZIF technology can use a cam and cover plate to move the package relative to the socket contacts in order to close the contacts. These zero insertion force sockets require the package to move to actuate the contacts. If the package is too large or heavy, the cam or follower can break before the package makes contact. In addition, pushing on the IC package can cause the present systems to be susceptible to warpage.

Lastly, typical ZIF contacts have only single point contact between the package pin and the socket contact.

What is needed is a fixed position zero insertion force socket contact that can accommodate large or heavy, high lead count packages without having to move the package to the socket contacts and provide a multiple point contact between the package pin and the socket contact.

DETAILED DESCRIPTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

The present invention provides a fixed position zero insertion force socket contact system that can accommodate large or heavy, high lead count packages without having to move the package to the socket contacts and provide a multiple point contact between the package pin and the socket contact. The socket and the vertical axis of the socket contact remain fixed relative to the pin as the socket contact system is opened and closed. In addition, the present invention allows the socket and socket contact to float relative to an insulator, reducing warping.

The present invention provides an electrical socket connection for coupling a conductive pin to a circuit board. The socket connection has several contact points that can be expanded in a substantially outwardly radial direction to create an opening sufficiently sized to allow the conductive pin to pass through the contact points with minimal insertion force. After the pin is inserted, the contact points can be retracted to form electrical interconnects with the pin. The contact points are electrically coupled to the remaining circuitry via the socket contact and socket. The present invention, therefore, provides a zero insertion force socket contact system that has multiple contact points and does not require secondary movement of the pin or circuit package.

Figure 1:
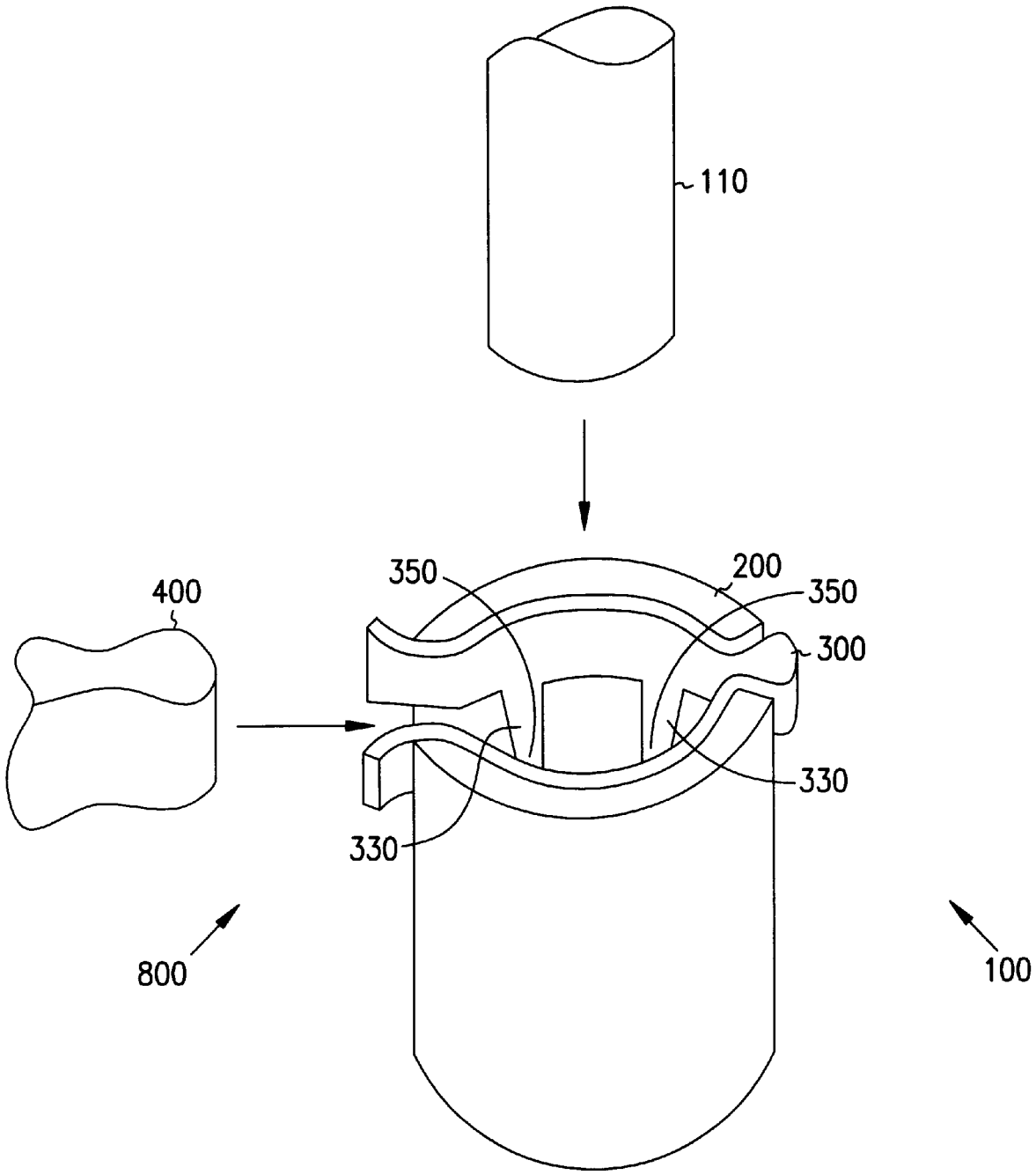
FIG. 1 is an exploded view of one embodiment of a socket assembly, pin, and actuator.

FIG. 1 shows the general assembly of one embodiment of a socket contact system 800. Socket connector or socket assembly 100 includes a socket 200 and a socket contact 300. Socket assembly 100 has a plurality of tynes 330 having a plurality of contact points 350 that can be expanded by actuator 400 to create an opening sufficiently sized to allow conductive pin 110 to pass through contact points 350 with minimal insertion force. Contact points 350 are the portions of socket contact 300 that contact conductive pin 110 when conductive pin 110 is inserted into socket assembly 100.

Figure 2:
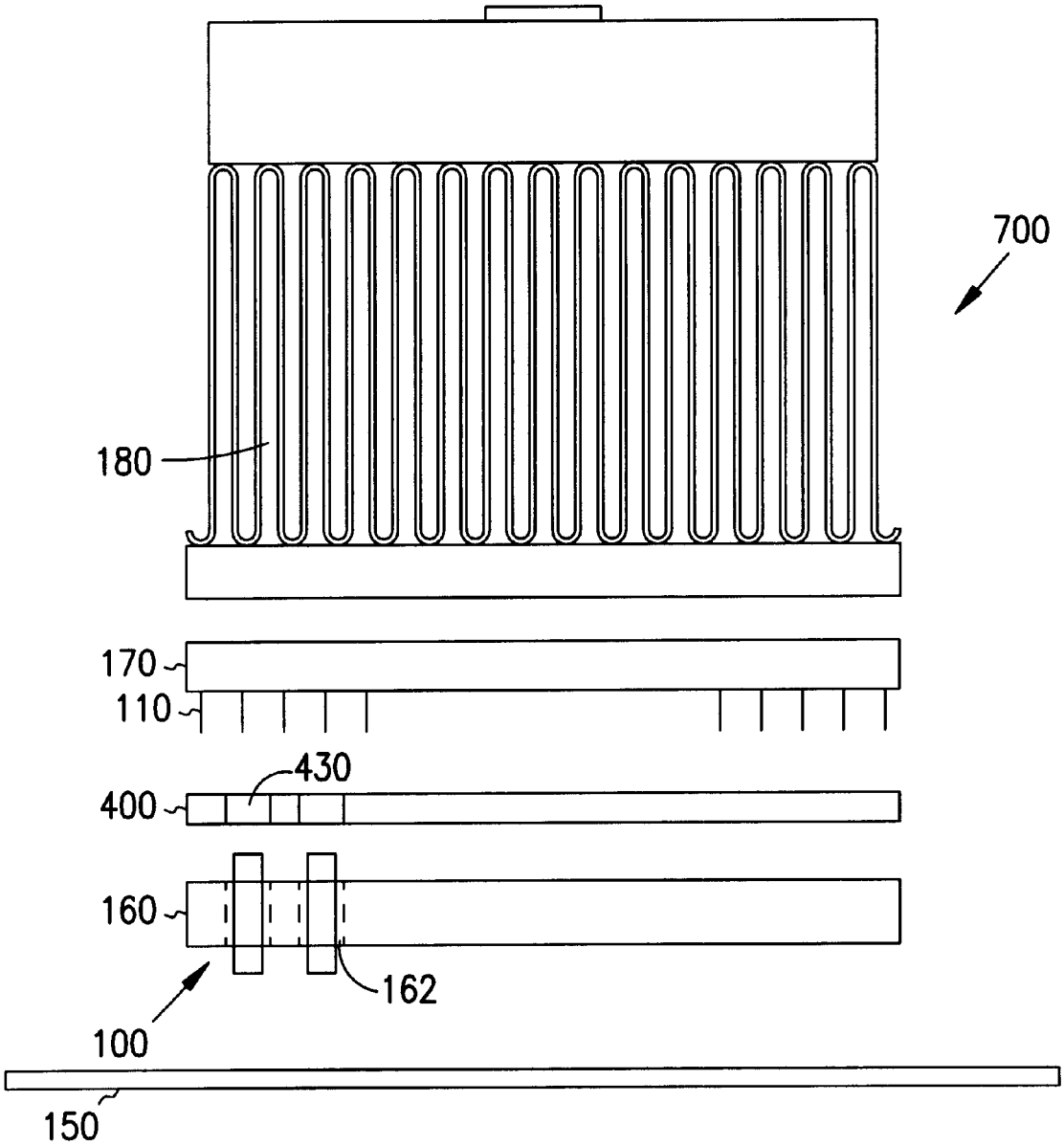
FIG. 2 is an exploded side view of one embodiment of a circuit assembly.

FIG. 2 shows the general assembly of one embodiment of a circuit assembly 700. As shown in FIG. 2, socket connector or assembly 100 attaches a motherboard 150 to an IC package 170 with a plurality of conductive pins 110. Alternatively, IC package 170 includes a thermal solution 180. An actuator 400 is located between package 170 and insulator 160. Socket assembly 100 is received through an insulator opening 162 in insulator 160 and an actuator opening 430 in actuator 400.

Figure 3:
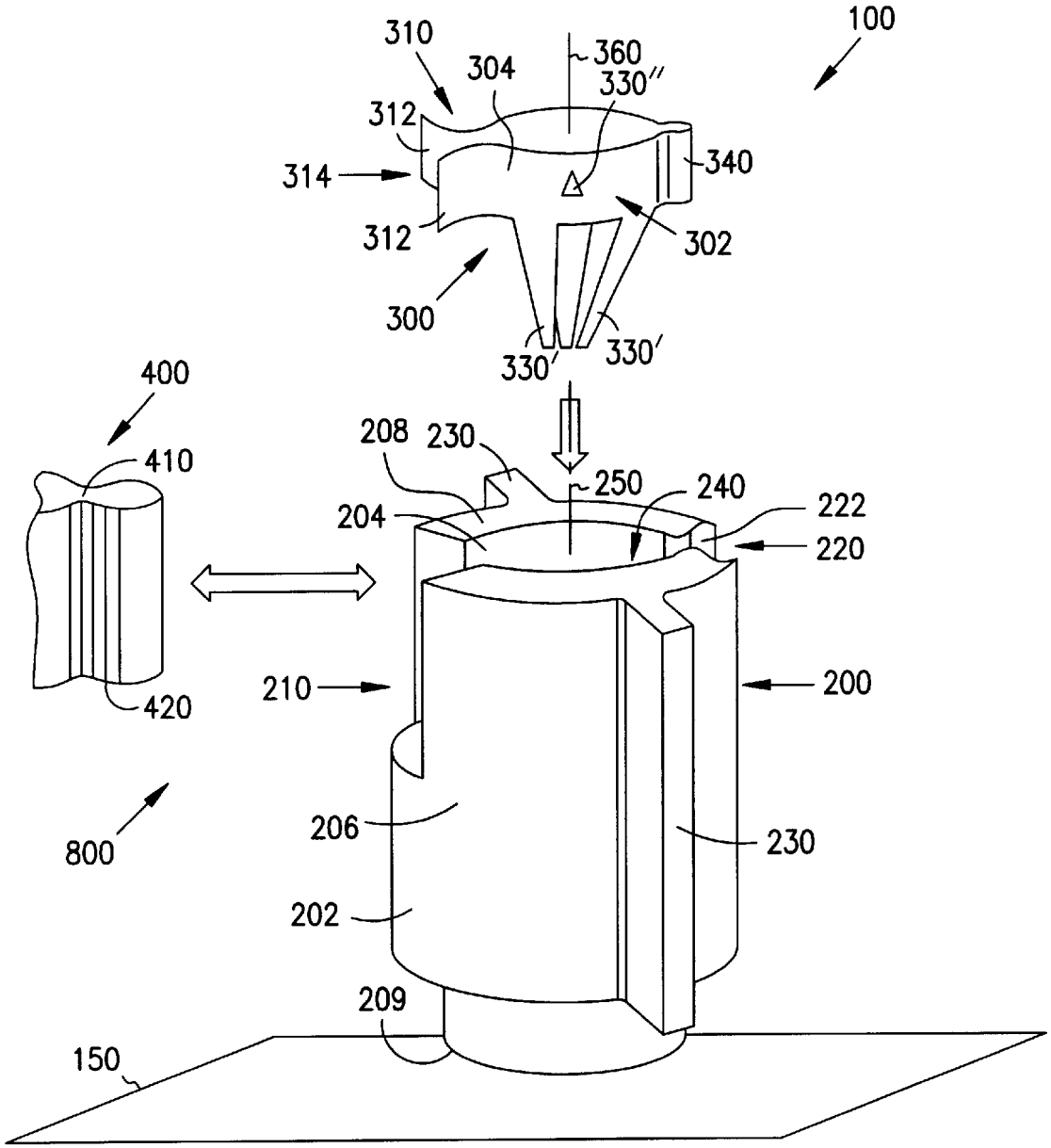
FIG. 3 is an exploded view of one embodiment of a socket, socket contact, and actuator.

As shown in FIG. 3, one embodiment of socket contact system 800 includes a socket assembly 100 and an actuator 400. Socket assembly 100 includes a socket 200 and a socket contact 300. Socket 200 will be explained first followed by socket contact 300, and actuator 400.

Socket 200 has a shell 202 having an actuator opening 210, a contact opening 220, tabs 230, a pin opening 240, and a substantially central axis 250. Each of the parts of socket 200 will be explained below in the order listed.

Shell 202 has an inside surface 204, an outside surface 206, a top 208, and a bottom 209. Shell 202 is an electrical conductor such as copper or a copper/beryllium alloy. Alternatively, shell 202 is made out of a non-conductor such as plastic with a conductive portion creating an electrical path between socket contact 300 and a motherboard 150. Bottom 209 is coated with tin or a tin alloy to allow socket 200 to be easily soldered to motherboard 150. Bottom 209 does not need to be flat. Optionally, inside surface 204 is coated with gold to improve conductivity and eliminate corrosion between socket contact 300 and socket 200. Shell 202 is shown as cylindrically shaped, alternatively, shell 202 comprises other shapes such as square or rectangular. A square or rectangular shaped shell 202 eliminates the need for tabs 230 to keep shell 202 from rotating relative to insulator 160 as explained below.

Actuator opening 210 extends through shell 202 from top edge 208 part way down the length of shell 202. Actuator opening 210 is sized and positioned so that blade 410 of actuator 400 can extend horizontally into shell 202 to open and close socket contact 300. Blade 410 moves perpendicular to substantially central axis 250.

Contact opening 220 extends through shell 202 from top edge 208 part way down the length of shell 202. Contact opening 220 is sized and positioned to receive hinge 340 of socket contact 300. Contact opening 220 is shown generally located opposing actuator opening 210, alternatively, contact opening 220 is located not opposing actuator opening 210. Actuator opening 210 and contact opening 220 extend down shell 202 equal distances to provide a generally level support surface for socket contact 300. Contact opening 220 has contact sides 222 that provide an electrical contact point between socket contact 300 and socket 200. Socket contact 300 is biased by hinge 340 against contact sides 222. Contact opening 220 is sized so that hinge 340 of socket contact 300, which is normally larger than contact opening 220, is removably fixed into place by squeezing hinge 340 to fit through contact opening 220. Alternatively, socket contact 300 floats along the z-axis (vertically) relative to actuator 400, relative to insulator 160, or relative to other socket contacts arranged in a pin array.

Tabs 230 extend radially outwardly from outside surface 206 of shell 202. Tabs 230 keep shell 202 from spinning in insulator openings 162 of insulator 160 as explained below. Keeping shell 202 from spinning allows actuator opening 210 of shell 202 to remain fixed in relation to actuator 400. Tabs 230 extend vertically along the length of shell 202.

Pin opening 240 extends vertically along the center of shell 202. Pin opening 240 is sized to receive a pin 110 and a surrounding barrel 304 and tynes 330 of socket contact 300. Pin opening 240 is shown as circular to accommodate pin 110 and socket contact 300.

Substantially central axis 250 extends vertically in the z-direction through the center of socket 200 and shell 202. Substantially central axis 250 coincides with vertical axis 360 of socket contact 300. Having now described socket 200, socket contact 300 will be explained next.

Socket contact 300 includes a band 302 and a plurality of tynes 330. Socket contact 300 is an electrical conductor such as copper or a copper/beryllium alloy. Each of the parts of band 302 will be described in the order listed, followed by a description of tynes 330.

The band 302 includes a barrel 304, a hinge 340 and an activator 310. Activator 310 includes curved ends 312 and band opening 314.

Barrel 304 is a circular thin flexible flat strip sized to fit around the pin 110 in pin opening 240 of socket 200. Activator 310 extends through actuator opening 210 and hinge 340 extends through contact opening 220. Barrel 304 is resilient and is biased towards pin 110 so that actuator 400 must force open socket contact 300.

Hinge 340 of socket contact 300 is sized to tightly fit in contact opening 220. Hinge 340 contacts the contact sides 222 of contact opening 220 and provides electrical continuity between contact 300 and socket 200 through hinge 340. Hinge 340 is resilient and may be squeezed to slightly bias hinge 340 so that it may be releasably secured and captured in contact opening 220. Socket contact 300 hinges at hinge 340 and contact opening 220 as socket contact 300 is opened and closed.

Figure 4:
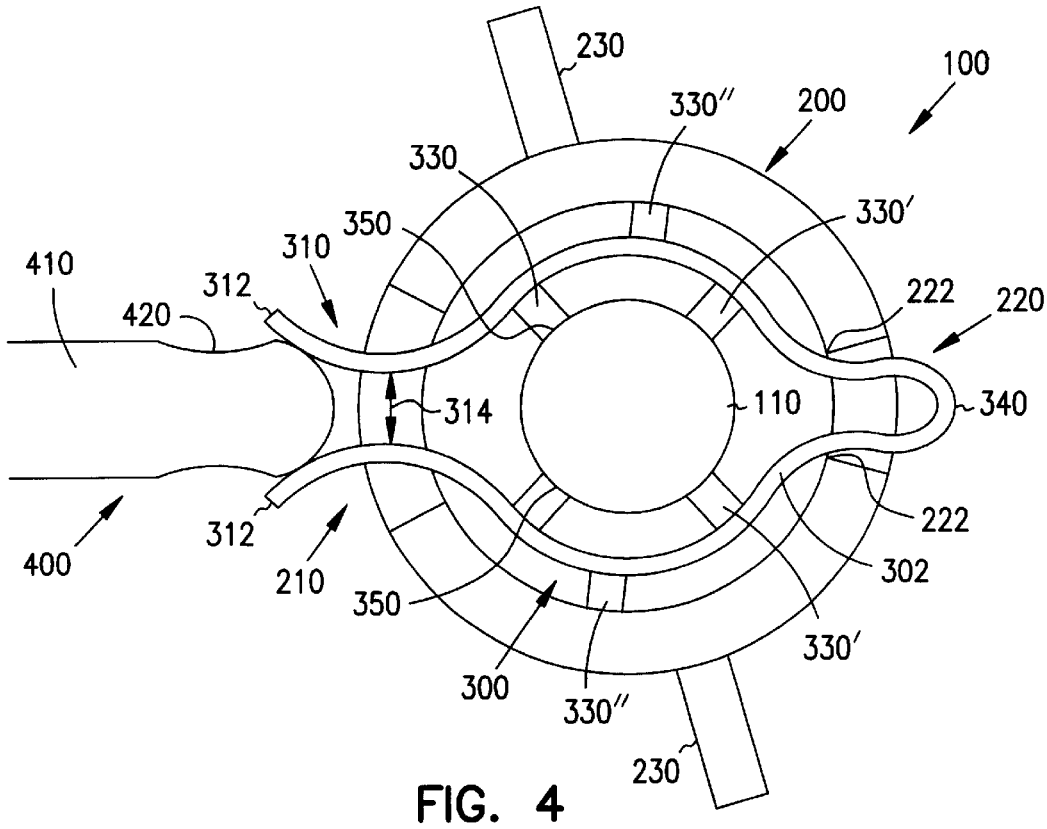
FIG. 4 is a top view of one embodiment of a socket, socket contact, actuator and pin showing the socket contact in a closed position.
Figure 5:
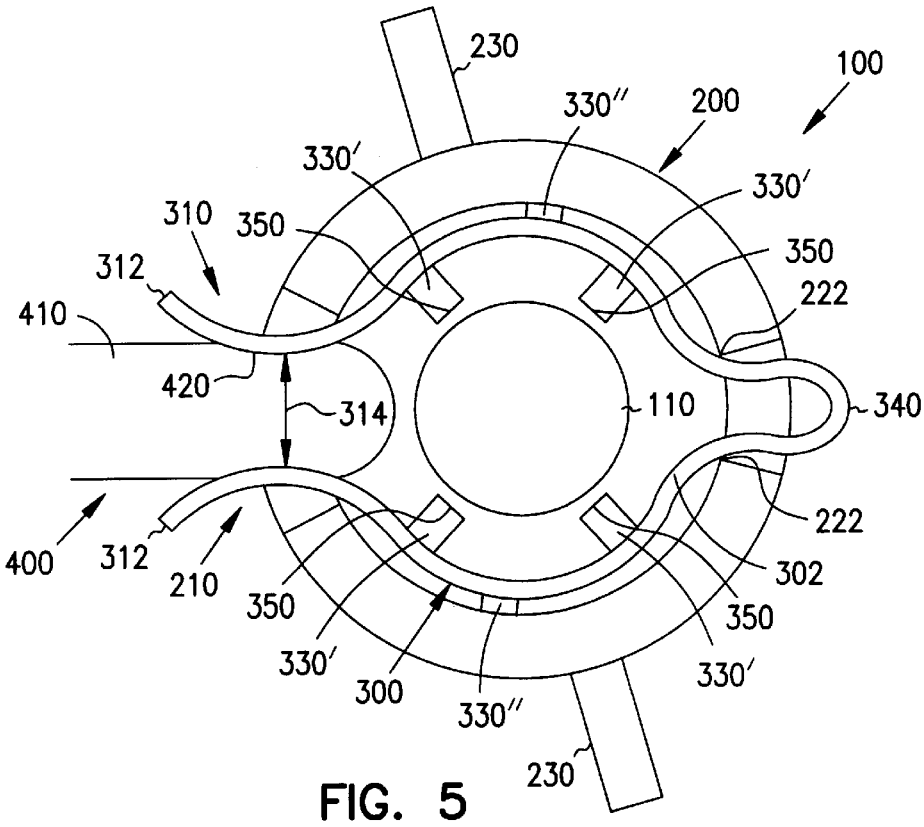
FIG. 5 is a top view of one embodiment of a socket, socket contact, actuator and pin showing the socket contact in an open position.

Referring to FIG. 4 and FIG. 5, activator 310 opens and closes socket contact 300 by moving socket contact 300 and tynes 330 having contact points 350 substantially radially away from and towards pin 110. Activator 310 is operated by blade 410 of actuator 400. As blade 410 is moved toward activator 310, activator 310 forces open socket contact 300 as shown in FIG. 5. As blade 410 is moved away from activator 310, socket contact 300 returns to the closed position as shown in FIG. 4. Activator 310 is shown as a band opening 314 in band 302 and a pair of curved ends 312 in band 302. Band opening 314 is located and sized in band 302 so that blade 410 opens and closes socket contact 300 on pin 110. Each curved end 312 is sized to fit a stop notch 420 of blade 410. Curved ends 312 are ends of band 302 that are curved in the opposite direction as circular band 302. As blade 410 is moved into band opening 314, socket contact 300 is opened. Blade 410 is inserted in actuator opening 210 to the open position. At the open position, the pair of stop notches 420 of blade 410 mate with curved ends 312 of socket contact 300. The combination of stop notches 420 and curved ends 312 provide an open stop position so that blade 410 is not inadvertently inserted too far into actuator opening 210 of socket 200, damaging the pin 110. Having described band 302 of socket contact 300, next tynes 330 of socket contact 300 will be explained below.

Referring to FIGS. 3–5, tynes 330 may include inwardly extending tynes 330' and outwardly extending tynes 330". Inwardly extending tynes 330' are spaced around the bottom perimeter of barrel 304 of socket contact 300 and extend inwardly from barrel 304 towards vertical axis 360 of socket contact 300 and downwardly away from barrel 304. Socket contact 300 preferably has a plurality of inwardly extending tynes 330'. The plurality of inwardly extending tynes 330' are biased towards vertical axis 360 of socket contact 300. Inwardly extending tynes 330' contact pin 110 at contact points 350 and provide electrical continuity between socket contact 300 and pin 110. Inwardly extending tynes 330' and contact points 350 move substantially radially away from pin 110, substantially central axis 250, and vertical axis 360 when socket contact 300 is opened. The open socket contact 300 allows pin 110 to be inserted into socket assembly 100 with significantly reduced or zero insertion force.

As socket contact 300 is moved to the closed position, inwardly extending tynes 330' and contact points 350 move substantially radially towards pin 110. As the substantially radial motion continues, tynes 330' and contact points 350 contact pin 110. As socket contact 300 continues to close, contact points 350 move substantially vertically down along the length of the pin 110. This movement along the side of pin 110 wipes contaminants and oxides away from the mating surface between the tynes 330' and pin 110 creating an air tight seal and providing a reliable electrical connection. In addition, the downward vertical movement of contact points 350 and tynes 330' against pin 110 tends to pull pin 110 into the socket creating a snug fit.

Outwardly extending tynes 330" are spaced about the circumference of barrel 304 of socket contact 300 and extend outwardly from barrel 304. Outwardly extending tynes 330" provide electrical points of contact between socket contact 300 and socket shell 200 in addition to hinge 340 and contact sides 222. Outwardly extending tynes 330" remain in contact with socket 200 as socket contact 300 and inwardly extending tynes 330' open and close by moving substantially radially with respect to pin 110. Alternatively, barrel 304 of socket contact 300 directly contacts pin 110 with contact points 350 without tynes 330. Barrel 304 and contact points 350 move radially towards and away from substantially central axis 250, vertical axis 360, and pin 110 as socket contact 300 is opened and closed. In the closed position, barrel 304 contacts pin 110 at a plurality of locations creating a plurality of contact points 350 between barrel 304 and pin 110. Having now described socket 300, actuator 400 will be explained below.

Figure 6:
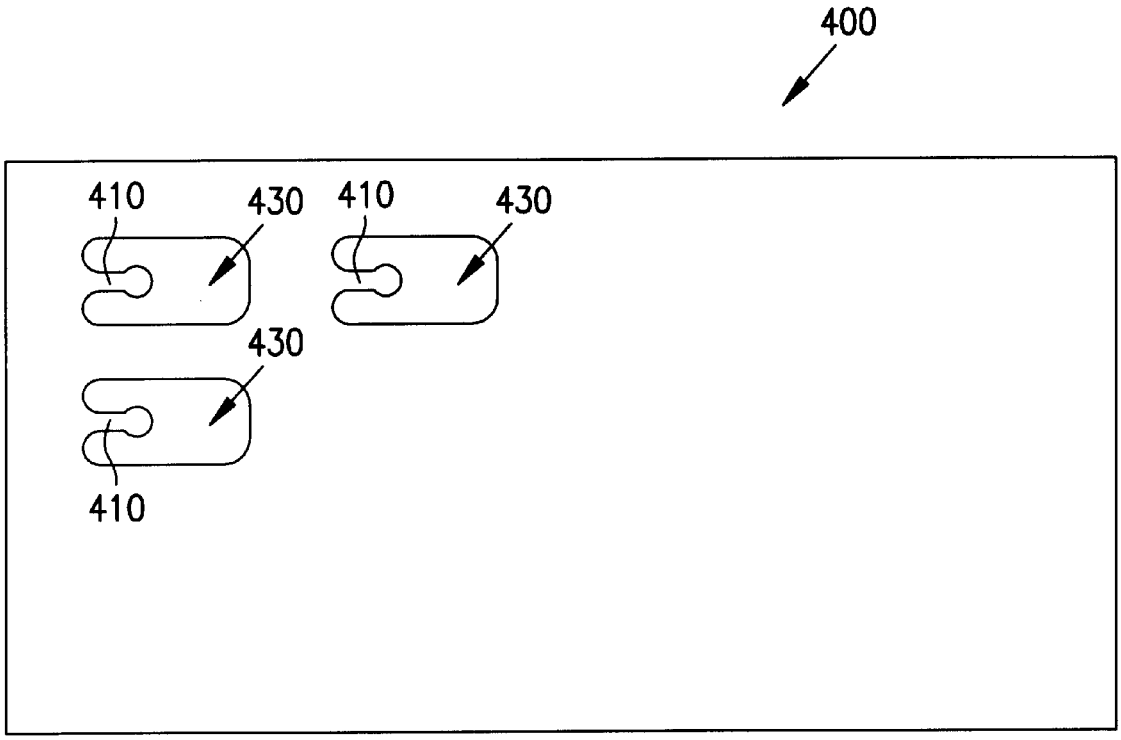
FIG. 6 is a top view of one embodiment of an actuator.
Figure 8:
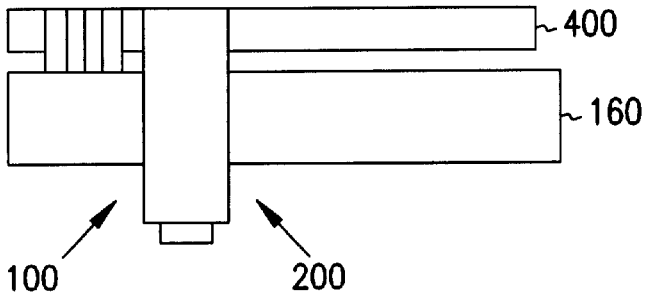
FIG. 8 is a side view of one embodiment of an insulator, socket assembly, and actuator.
Figure 9A:
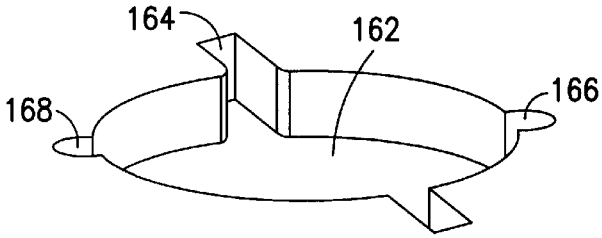
FIG. 9 is a partial perspective view of one embodiment of the insulator showing details of the insulator opening.
Figure 9B:
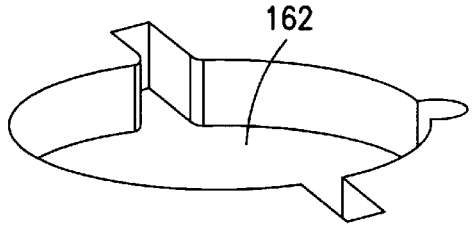
Figure 9C:
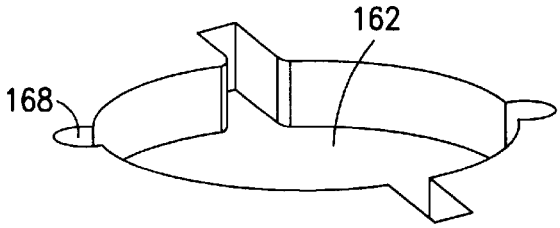
Figure 9D:
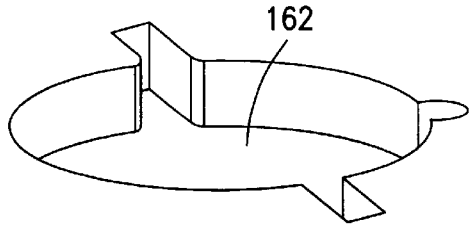

As shown in FIG. 3 and more specifically in FIG. 6, top cover or actuator 400 includes a blade 410. Blade 410 includes a stop notch 420. Actuator 400 is shown as a flat plate defining a plurality of socket openings 430 and blades 410. Socket openings 430 are sized and located to correspond to an array of sockets 200. Socket openings 430 are of any shape as long as blades 410 have enough room to open and close socket contacts 300. As shown in FIG. 2 and FIG. 8, actuator 400 may be located on top of an insulator 160 with socket assemblies 100 and sockets 200 protruding through insulator 160. Having now described actuator 400, insulator 160 will be explained below.

Figure 7:
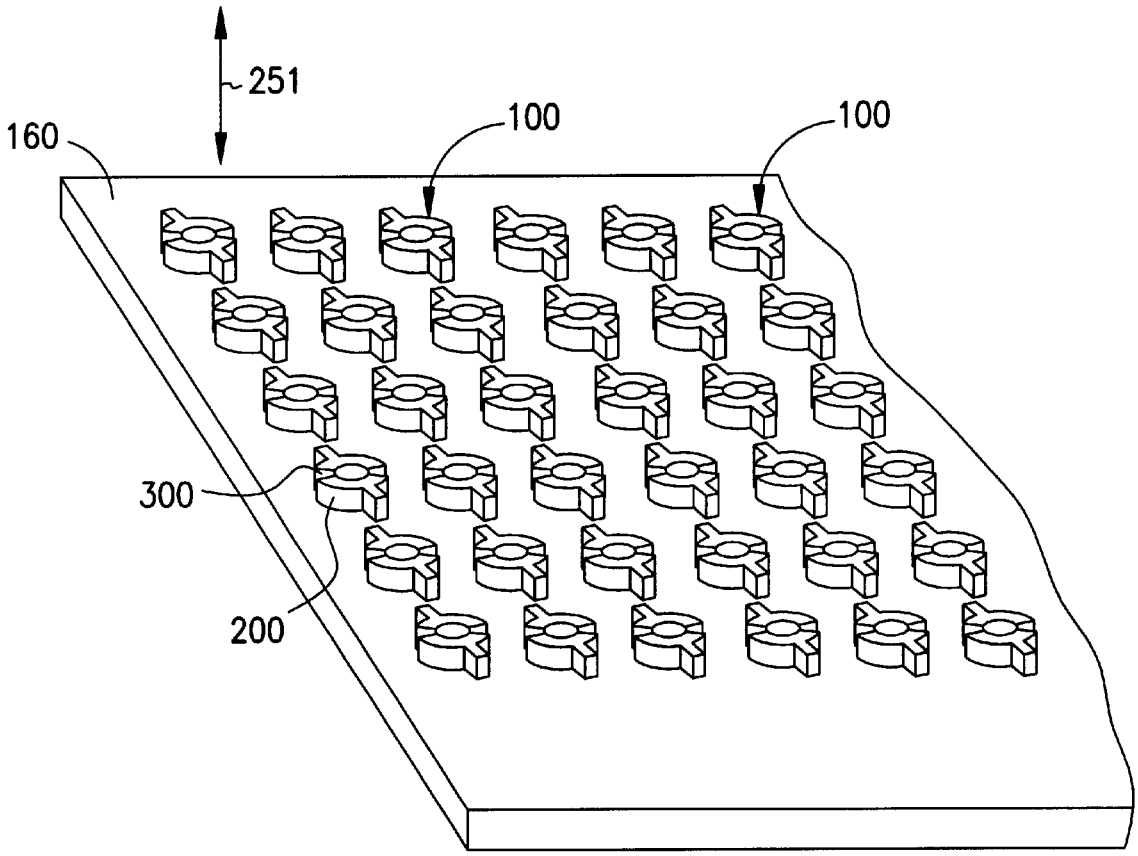
FIG. 7 is a perspective view of one embodiment of an insulator with a plurality of inserted socket assemblies.

As shown in FIGS. 2 and 7–9, an insulator 160 holds a plurality of socket assemblies 100 in position for attachment to a plurality of pins 110 of a package 170. Referring to FIGS. 7–9, insulator 160 has insulator openings 162 for receiving socket assemblies 100. Insulator openings 162 are sized to allow the socket assemblies 100 to move in the z-direction (vertically) 251 within insulator 160, but not to rotate within insulator 160. Insulator openings 162 include tab openings 164, hinge openings 166, and activator openings 168. Tab openings 164 are for receiving tabs 230 of socket assemblies 100. Hinge openings 166 are for receiving hinge 340 of socket contact 300. Activator openings 168 are for receiving activator 310 of socket contact 300. Hinge openings 166 and activator openings 168 are sized to allow hinge 340 and activator 310 to move vertically with respect to insulator 160 with shell assembly 100 without interference from insulator 160. Having now described one embodiment, additional embodiments will be explained below.

Figure 10:
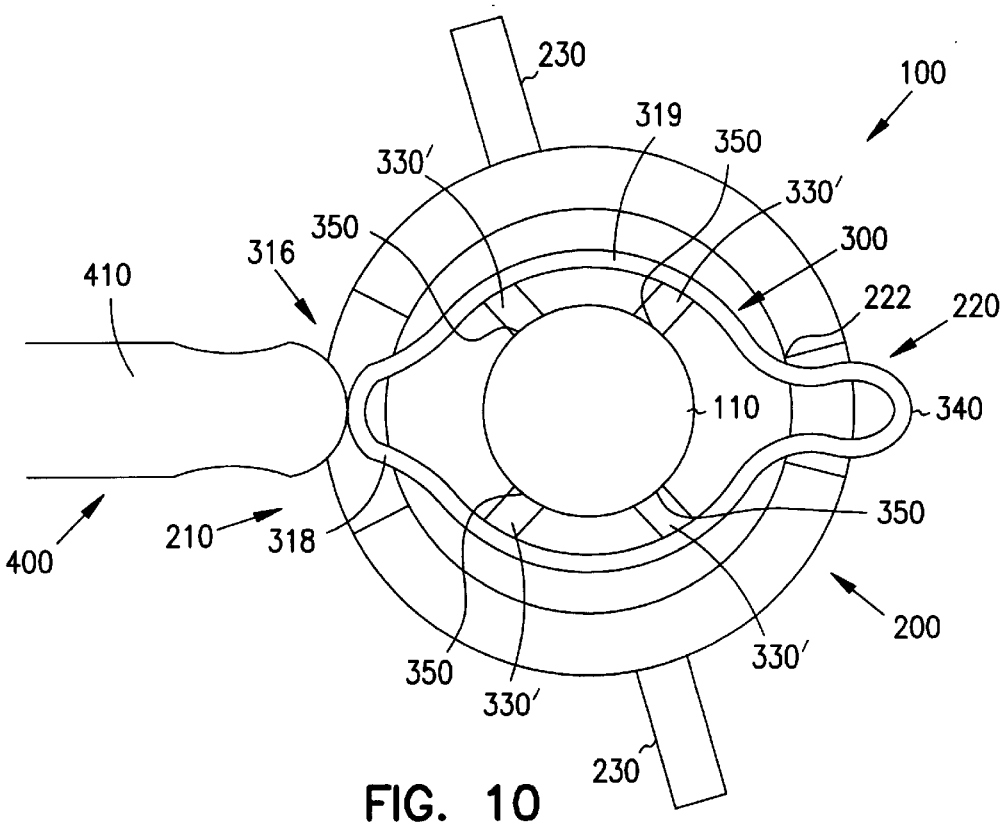
FIG. 10 is a top view of a second embodiment of a socket, socket contact, actuator and pin showing the socket contact in a closed position.
Figure 11:
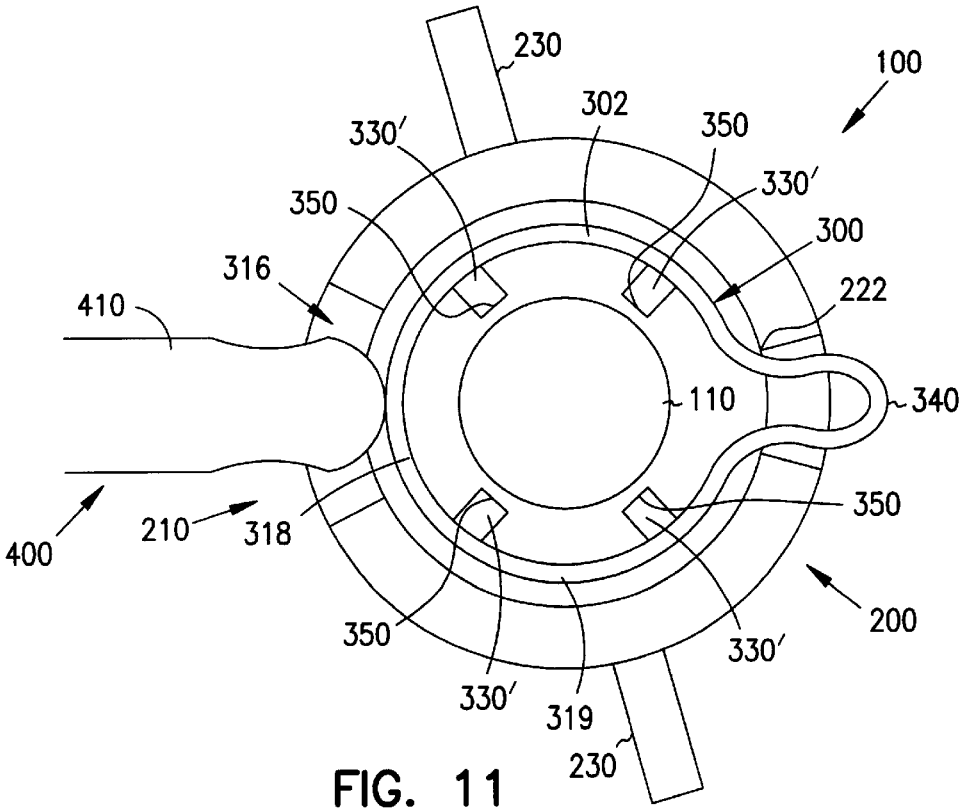
FIG. 11 is top view of a second embodiment of a socket, socket contact, actuator and pin showing the socket contact in an open position.

Referring to FIG. 10 and FIG. 11, a second embodiment of an activator 316 of socket contact 300 is shown. FIG. 10 shows socket contact 300 in a closed position. FIG. 11 shows socket contact 300 in an open position. Activator 316 consists of a closed loop band 319 with a bulge 318. Closed loop band 319 is similar to band 302 shown in FIG. 4 and FIG. 5, except that it does not have a band opening 314 and is resilient enough to allow deformation and returns to its original shape. As blade 410 moves into actuator opening 210, blade 410 pushes on a bulge 318 in band 319 of socket contact 300. Blade 410 forces bulge 318 into socket 200 causing socket contact 300, tynes 330, and contact points 350 to move substantially radially outwardly from pin 110.

Figure 12:
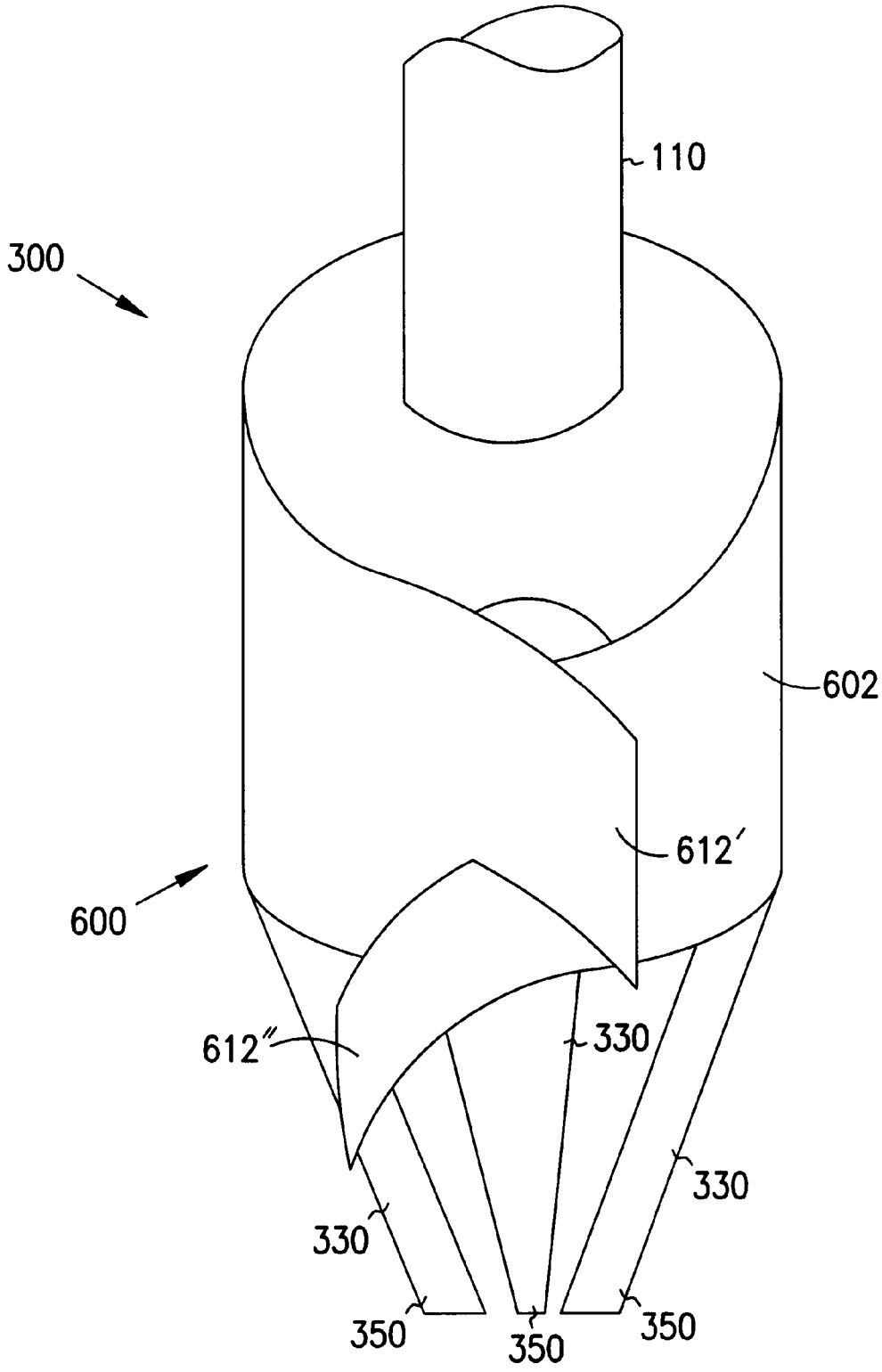
FIG. 12 is perspective view of a third embodiment of a socket contact showing the socket contact having overlapping ends.
Figure 13:
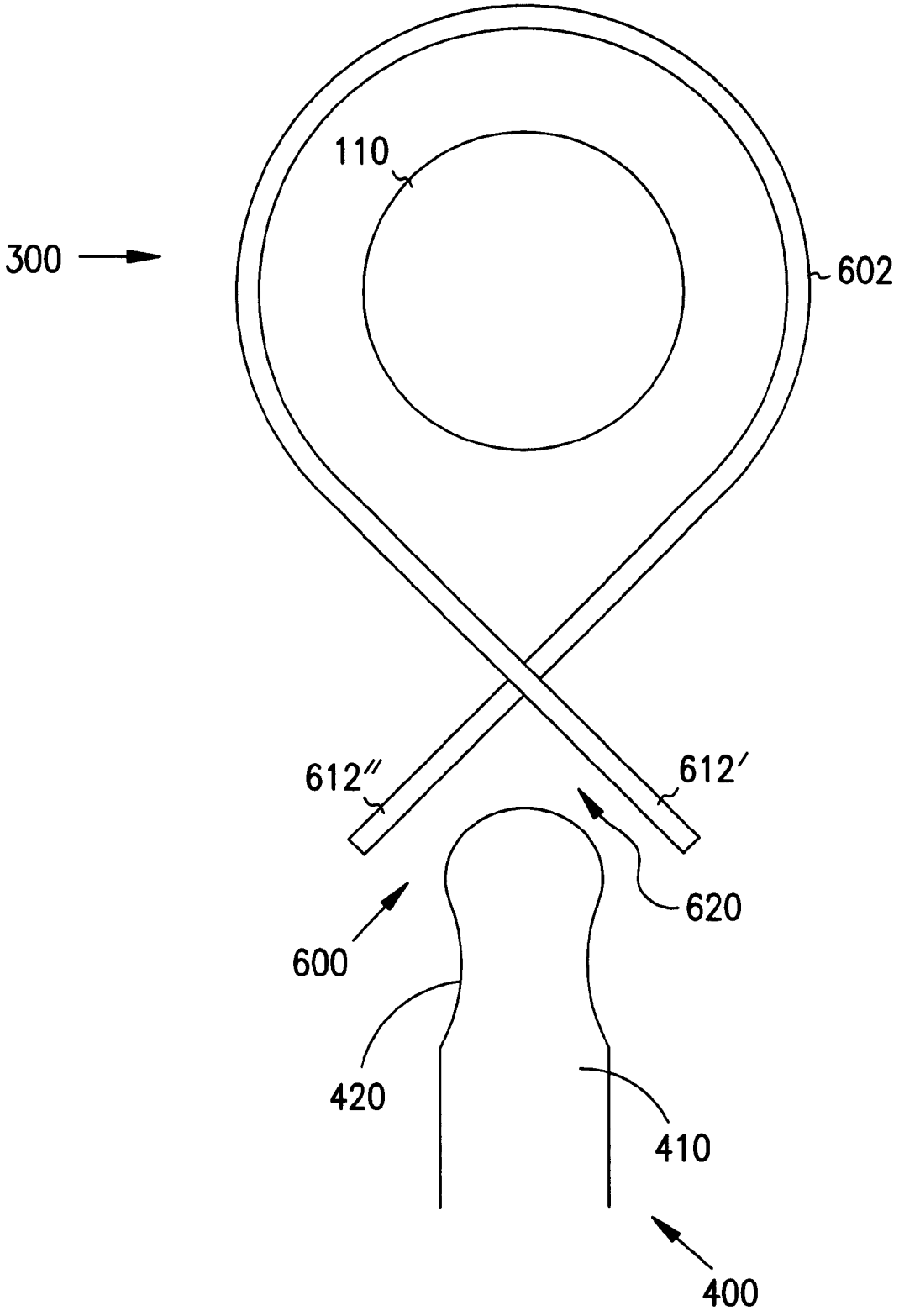
FIG. 13 is top view of a third embodiment of a socket contact showing the socket contact having overlapping ends.

Referring to FIG. 12 and FIG. 13, a third embodiment of an activator 600 is shown. Activator 600 consists of a band 602 having overlapping ends 612. Band 602 is similar to band 302 except that ends 612 overlap instead of extending outwardly away from each other. Ends 612 include an upper end 612' and a lower end 612". The upper end 612' and lower end 612" each have a notch so that they can overlap each other. The band 602 opens and closes as blade 410 engages overlapping ends 612 causing socket contact 300, tynes 330, and contact points 350 to move substantially radially inwardly and outwardly relative to pin 110. The blade 410 engages the ends 612 by squeezing the ends 612 together thereby opening the socket contact 300. Activator 600 opens and closes socket contact 300 by moving socket contact 300 and tynes 330 having contact points 350 substantially radially away from and towards pin 110. Activator 600 is operated by blade 410 of actuator 400. Activator 600 is shown having a band opening 620 in band 602 and a pair of ends 612 in band 602. The ends 612 are shown with curved ends. Band opening 620 is located and sized in band 602 so that blade 410 opens and closes socket contact 300 on pin 110. Ends 612 of band 602 are curved in the opposite direction as circular band 602. Alternatively, the ends 612 are straight.

Figure 14:
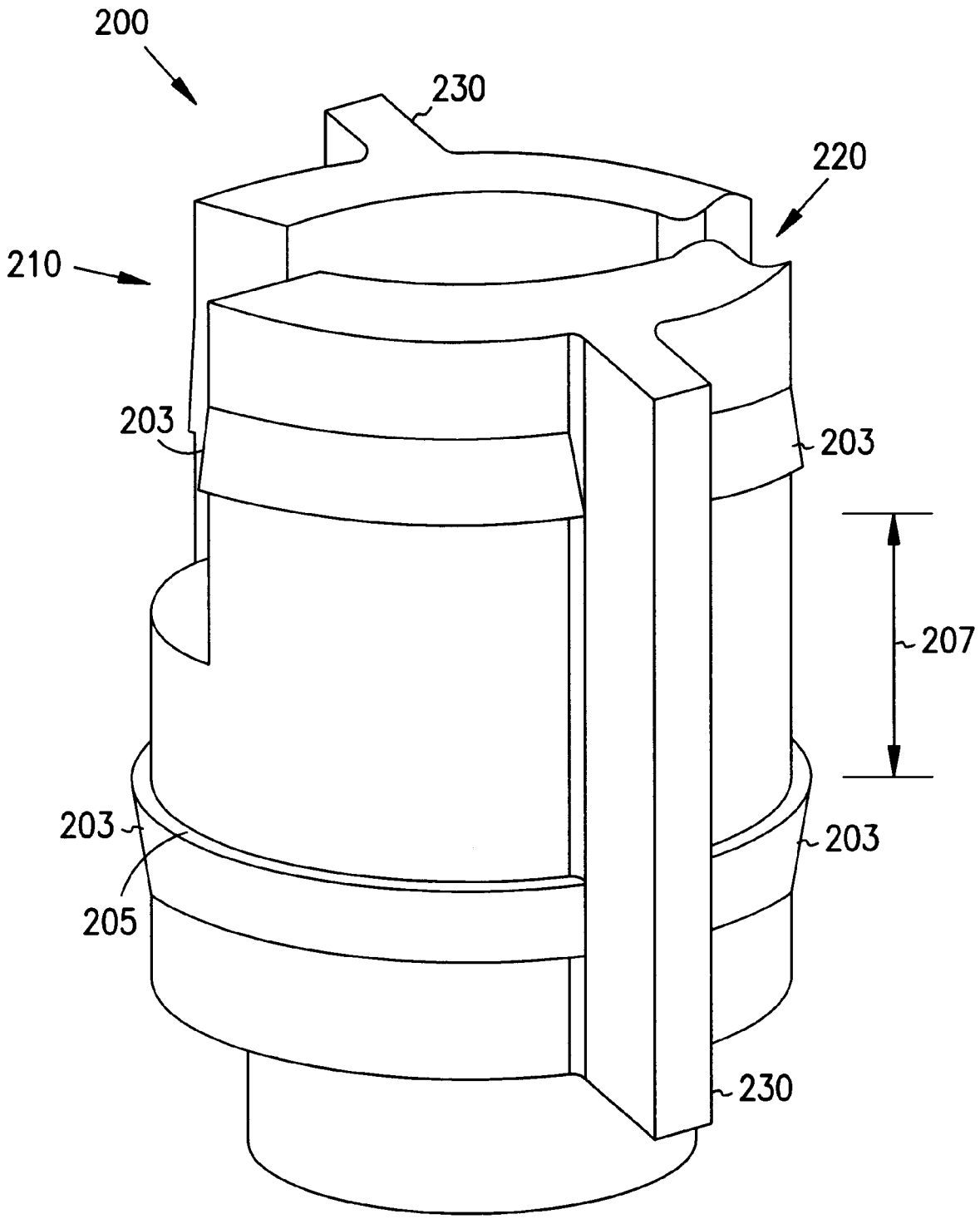
FIG. 14 is a perspective view of a second embodiment of a socket showing a pair of circumscribed ribs.

Referring to FIG. 14, a second embodiment of socket 200 with a pair of ribs 203 is shown. Socket 200 may include a pair of ribs 203 circumscribing socket shell 202. Ribs 203 position socket 200 within insulator 160 (See FIG. 2 and FIG. 7). Ribs 203 provide vertical positioning for socket assembly 100 so that blade 410 of actuator 400 is aligned with actuator opening 210. (See FIG. 2 and FIG. 7). Ribs 203 are separated by a gap 207 so that edges 205 of ribs 203 are located on each side of insulator 160. Insulator 160 is positioned between ribs 203 by pushing socket 200 through insulator opening 162 of insulator 160. Insulator 160 and ribs 203 are resilient so that ribs 203 pass through insulator opening 162 and return to their original shape. Optionally, gap 207 is larger than the thickness of insulator 160 to allow socket assembly 100 to move in the z-direction (vertically) relative to insulator 160 and relative to pins 110.

Figure 15:
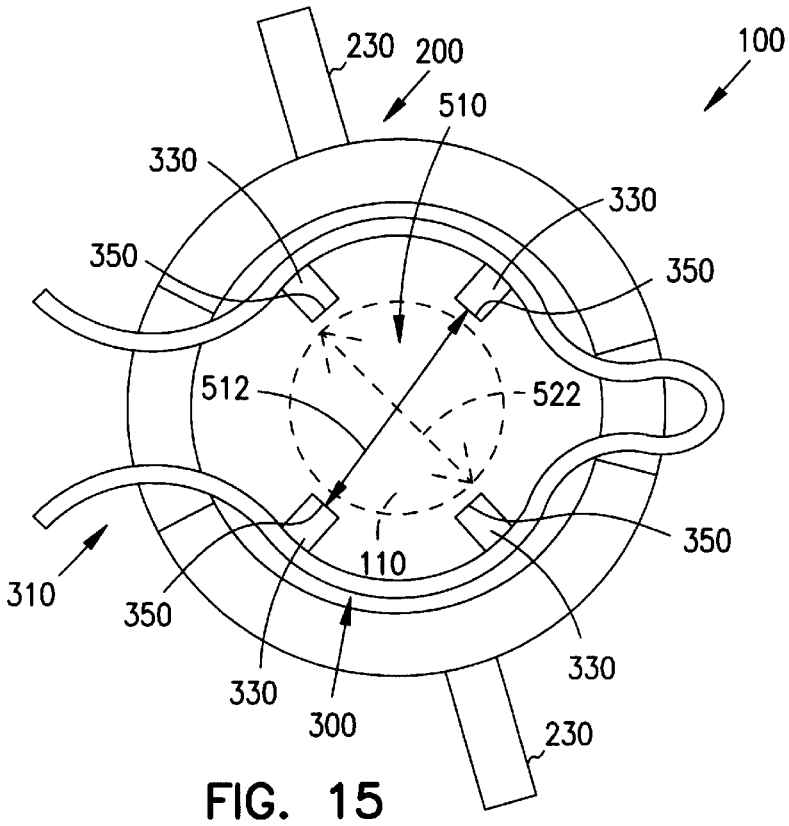
FIG. 15 is a top view of one embodiment showing a plurality of electrical contacts defining a first opening having a diameter greater than a diameter of a conductive pin.
Figure 16:
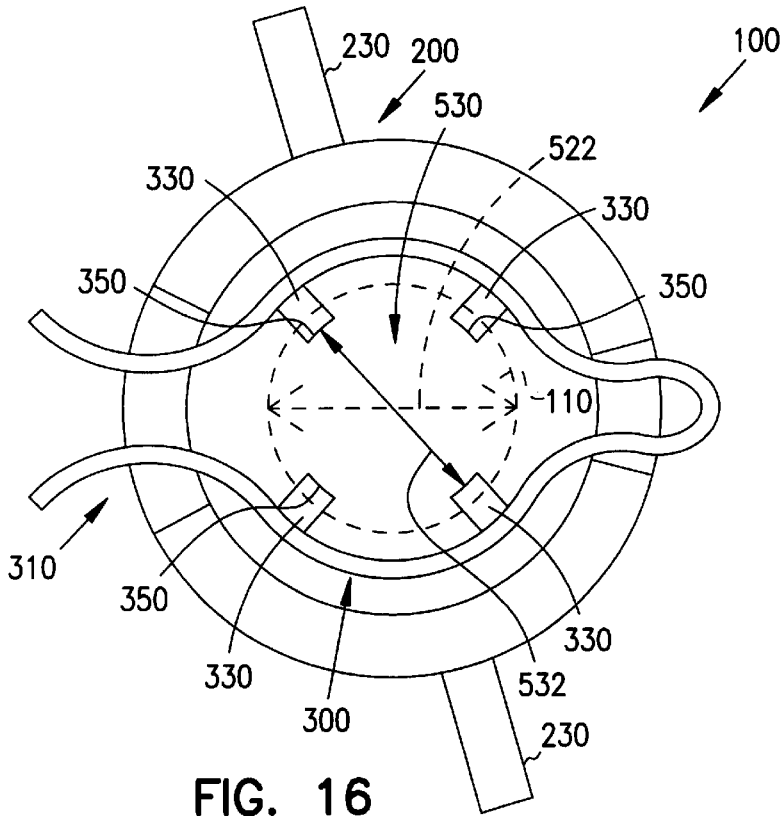
FIG. 16 is a top view of one embodiment showing a plurality of electrical contacts defining a second opening having a diameter less than a diameter of a conductive pin.

Referring to FIG. 15 and FIG. 16, a method of providing an electrical connection is explained. FIG. 15 shows a first opening 510 and FIG. 16 shows a second opening 530. As shown in FIG. 15, an electrical connection is provided by substantially radially extending a plurality of tynes or electrical contacts 330 to define a first opening 510 having a diameter 512 that is greater than a diameter 522 of conductive pin 110. As shown in FIG. 16, the plurality of electrical contacts 330 are substantially radially retracted to define a second opening 530 having a diameter 532 that is less than diameter 522 of conductive pin 110. When the plurality of electrical contacts 330 are substantially retracted, the plurality of electrical contacts 330 form a plurality of electrical contact points 350 with conductive pin 110 when conductive pin 110 is inserted into first opening 510. Optionally, the method includes inserting conductive pin 110 before radially retracting the plurality of electrical contacts 330. Optionally, the method includes wiping conductive pin 110 with the plutrality of electrical contacts 330 and contact points 350. Optionally, the method includes moving the plurality of contact points 350 vertically along conductive pin 110.

In conclusion, one embodiment includes a socket connector 100 including a socket 200 and a socket contact 300. Socket 200 has a pin opening 240 with a substantially central axis 250. Socket contact 300 has a plurality of contact points 350 and is positioned in pin opening 240 of socket 200. Socket contact 300 is movable between an open position and a closed position. Contact points 350 are moveable with respect to the substantially central axis 250 between the open position and the closed position. In the open position, contact points 350 are positioned outwardly relative to the position of the contact points 350 in the closed position.

Optionally, socket connector 100 includes a socket contact 300 with a plurality of inwardly extending tynes 330', each inwardly extending tyne 330' providing at least one contact point 350. Optionally, socket contact 300 includes a plurality of outwardly extending tynes 330". Optionally, socket connector 100 includes a socket contact 300 with a hinge 340 biased in a hinge opening 220 in socket 200, hinge 340 causing electrical continuity between socket contact 300 and socket 200. Optionally, socket connector 100 includes a socket contact 300 with an activator 310 positioned in an actuator opening 210 of socket 200 with activator 310 moveable between a corresponding open and closed position. Optionally, activator 310 includes a band opening 314 in a band 302 with a pair of curved ends 312 or an activator 316 with a closed loop band 319 and a bulge 318 or an activator 600 with a pair of overlapping ends 612. Optionally, socket connector 100 includes a socket 200 having a plurality of tabs 230 extending radially from and vertically along socket 200 and a pair of ribs 203 circumscribing socket 200.

One embodiment can also include a socket contact system 800 having a socket connector 100 as described above and an actuator 400. Actuator 400 is positioned in an actuator opening 210 of socket 200 and is moveable between a corresponding open and closed position. Optionally, the socket contact system 800 includes an actuator 400 with a blade 410 moveable perpendicular to substantially central axis 250 of socket 200 and positioned between the pair of curved ends 312 of socket contact 300. Optionally, blade 410 has a stop notch 420 that mates with one of the curved ends 312 when socket contact 300 is open.

Optionally, the socket contact system 800 includes an insulator 160 with socket 200 in an insulator opening 162. Optionally, the socket contact system 800 includes a socket 200 and a socket contact 300 that moves in the z-direction (vertically) relative to insulator 160. Optionally, the socket contact system includes an insulator 160 with a plurality of sockets 200 in a plurality of insulator openings 162. Optionally, insulator openings 162 include tab openings 164 for tabs 230 of sockets 200. Optionally, insulator 160 is positioned between the pair of ribs 203 circumscribing socket 200.

One embodiment can also include a circuit assembly 700 having a plurality of socket connectors 100 as described above, an actuator 400 as described above, an insulator 160 as described above with the plurality of sockets connectors 100 positioned in a plurality of insulator openings 162, and a package 170 with a plurality of corresponding pins 110 received within socket assemblies 100.

Optionally, the circuit assembly 700 includes a plurality of pins 110 arranged in a pin grid array. Optionally, the circuit assembly 700 includes a package 170 with a thermal solution 180, either removably or fixedly attached to package 170. Optionally, the circuit assembly 700 includes a motherboard 150 with the socket 200 attached to motherboard 150.

One embodiment also includes a method of electrically connecting a pin 110 and a socket assembly 100 including providing a pin 110 and a socket assembly 100, the socket assembly 100 including a socket 200 and socket contact 300; opening socket contact 300 in a direction away from substantially central axis 250 of socket 200; inserting pin 110 into socket 200; closing socket contact 300 in a direction towards pin 110; and contacting pin 110 with a plurality of contact points 350.

Optionally, the method includes providing an actuator 400 and moving actuator 400 relative to pin 110 and socket 200 without moving pin 110 relative to socket 200. Optionally, the method includes providing an insulator 160 and after closing socket contact 300, floating socket 200 and socket contact 300 in a z-direction relative to insulator 160.

One embodiment also includes a method of providing an electrical connection including extending a plurality of electrical contacts 330 to define a first opening 510 having a diameter 512 that is greater than a diameter 522 of a conductive pin 110; and retracting the plurality of electrical contacts 330 to define a second opening 530 having a diameter 532 that is less than diameter 522 of conductive pin 110, such that the plurality of electrical contacts 330 form a plurality of electrical contact points 350 with conductive pin 110 when conductive pin 110 is inserted into first opening 510.

Optionally, the method includes inserting a conductive pin 110 before retracting the plurality of electrical contacts 330.

The present invention provides an electrical socket connection for coupling a conductive pin to a circuit board. The socket connection has several contact points that can be expanded to create an opening sufficiently sized to allow the conductive pin to pass through the contact points with minimal insertion force. After the pin is inserted, the contact points can be retracted to form electrical interconnects with the pin. The contacts are electrically coupled to the remaining circuitry via the socket. The present invention, therefore, provides a zero insertion force socket that has multiple contact points and does not require secondary movement of the pin or circuit package.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A socket connector comprising:

a socket having a pin opening, the pin opening having a substantially central axis, wherein the socket further comprises a pair of ribs circumscribing the socket;

a socket contact having a plurality of contact points, the socket contact positioned in the pin opening of the socket, the socket contact comprising a band moveable between an open position and a closed position by an actuator, wherein when the band is in the closed position, the actuator is outside the band; and wherein the plurality of contact points are moveable with respect to the substantially central axis between the open position and the closed position and the plurality of contact points in the open position are positioned outwardly relative to the position of the plurality of contact points in the closed position.

2. The socket connector of claim 1 wherein the socket contact further comprises a hinge and the socket further comprises a hinge opening, the hinge biased in the hinge opening, the socket and socket contact having electrical continuity between the socket contact and the socket through the hinge.

3. The socket connector of claim 1 wherein the socket further comprises a plurality of tabs, the tabs extending radially from the socket and vertically along the socket.

4. The socket connector of claim 1 wherein the socket contact further comprises a hinge, a plurality of tynes, and an activator;

the socket having a hinge opening and an actuator opening, the socket further comprising a plurality of tabs;

the hinge biased in the hinge opening, the socket contact and the socket having electrical continuity between the socket contact and the socket through the hinge;

the activator having the band, the band having a band opening and a pair of curved ends, the activator positioned in the actuator opening, the activator moveable between an open position and a closed position corresponding to the open position and the closed position of the socket contact;

the plurality of tynes including a plurality of outwardly extending tynes, each of the plurality of tynes having at least one of the plurality of contact points;

the plurality of tabs extending radially from the socket and vertically along the socket.

5. The socket connector of claim 1 wherein the socket contact further comprises a plurality of tynes.

6. The socket connector of claim 5 wherein the plurality of tynes are inwardly extending tynes, each inwardly extending tyne having at least one of the plurality of contact points.

7. The socket connector of claim 6 wherein the plurality of tynes further comprise a plurality of outwardly extending tynes.

8. The socket connector of claim 1 wherein the socket contact further comprises an activator and the socket further comprises an actuator opening, the activator positioned in the actuator opening, the activator moveable between an open position and a closed position corresponding to the open position and the closed position of the socket contact.

9. The socket connector of claim 8 wherein the band further has a band opening and a pair of curved ends, the activator comprising the band opening and the pair of curved ends.

10. The socket connector of claim 8 wherein the socket contact further comprises a closed loop band and a bulge, the activator comprising the closed loop band and the bulge.

11. The socket connector of claim 8 wherein the band further has a pair of overlapping ends, the activator comprising the pair of overlapping ends.

12. The socket connector of claim 1 wherein the plurality of contact points are wipeable on a pin between the open position and the closed position.

13. The socket connector of claim 12 wherein the plurality of contact points are moveable vertically along the pin.

14. A socket contact system comprising:

a socket having an actuator opening and a pin opening, the pin opening having a substantially central axis;

a socket contact comprising a band moveable between an open position and a closed position, the socket contact having a plurality of contact points, the socket contact positioned in the pin opening of the socket;

an insulator having an insulator opening, the socket positioned in the insulator opening;

a pair of ribs circumscribing the socket, the insulator positioned between the pair of ribs;

wherein the plurality of contact points are moveable with respect to the substantially central axis between the open position and the closed position and the plurality of contact points in the open position are positioned outwardly relative to the position of the plurality of contact points in the closed position; and an actuator, the actuator positioned in the actuator opening, the actuator moveable between an open position and a closed position corresponding to the open position and the closed position of the socket contact, wherein the actuator is separate from the band.

15. The socket contact system of claim 14 wherein the actuator opening is perpendicular to the substantially central axis.

16. The socket contact system of claim 14 wherein the socket contact is moveable in a z-direction relative to the insulator.

17. The socket contact system of claim 14 wherein the insulator has a plurality of insulator openings and a plurality of sockets positioned in the plurality of insulator openings.

18. The socket contact system of claim 14 wherein the insulator opening has a plurality of tab openings and wherein the socket further comprises a plurality of tabs, the plurality of tabs positioned in the plurality of tab openings.

19. The socket contact system of claim 14 wherein the socket is moveable in a z-direction relative to the insulator.

20. The socket contact system of claim 14 wherein the actuator is comprised of a blade, the blade moveable perpendicular to the substantially central axis.

21. The socket contact system of claim 20 wherein the socket contact further comprises a hinge, a plurality of tynes, and an activator;

the socket having a hinge opening;

the hinge biased in the hinge opening, the socket contact and socket having electrical continuity between the socket contact and the socket through the hinge;

the activator having the band, the band having a band opening and a pair of curved ends, the activator positioned in the actuator opening, the activator moveable between an open position and a closed position corresponding to the open position and the closed position of the socket contact; and the blade positioned between the pair of curved ends.

22. The socket contact system of claim 21 wherein the blade has a stop notch and an open position and a closed position corresponding to the open position and the closed position of the socket contact, in the open position the stop notch mated with one of the curved ends.

23. The socket contact system of claim 22 wherein the socket has an actuator opening, the socket further comprising a plurality of tabs;

the plurality of tynes comprises a plurality of outwardly extending tynes, each of the plurality of outwardly extending tynes having at least one of the plurality of contact points;

the plurality of tabs extending radially from the socket and vertically along the socket.

24. The socket contact system of claim 23, wherein the insulator further comprises a plurality of insulator openings, wherein a plurality of sockets are positioned in the plurality of insulator openings, each of the plurality of insulator openings having a plurality of tab openings and the plurality of tabs positioned in the plurality of tab openings, wherein the socket and the socket contact are moveable in a z-direction relative to the insulator.

25. An circuit assembly comprising:

a plurality of sockets, each of the sockets having an actuator opening, a pair of ribs circumscribing the socket, and a pin opening, the pin opening having a substantially central axis;

a plurality of socket contacts, comprising a plurality of bands moveable between an open position and a closed position, corresponding to the plurality of sockets, each of the socket contacts positioned in the pin opening of each of the sockets, wherein each of the socket contacts further comprises an activator, the activator positioned in the actuator opening, the activator moveable between an open position and a closed position corresponding to the open position and the closed position of the socket contact;

wherein the plurality of contact points are moveable with respect to the substantially central axis between the open position and the closed position and the plurality of contact points in the open position are positioned outwardly relative to the position of the plurality of contact points in the closed position;

an actuator, the actuator positioned in the actuator opening, the actuator moveable between an open position and a closed position corresponding to the open position and the closed position of the socket contact;

an insulator having a plurality of insulator openings, the plurality of sockets positioned in the insulator openings; and a package having a plurality of pins, the plurality of pins corresponding to the plurality of sockets and the plurality of socket contacts, the pins received within the sockets.

26. The circuit assembly of claim 25 wherein the plurality of pins are arranged in a pin grid array.

27. The circuit assembly of claim 25 further comprising a motherboard, the sockets attached to the motherboard.

28. The circuit assembly of claim 25 wherein each socket contact further comprises a hinge and a plurality of tynes;

each socket having a hinge opening and an actuator opening, the actuator opening perpendicular to the substantially central axis;

each socket further comprising a plurality of tabs;

the hinge biased in the hinge opening, the socket contact and socket having electrical continuity between the socket contact and the socket through the hinge;

the activator having the band, the band having a band opening and a pair of curved ends;

the plurality of tynes including a plurality of outwardly extending tynes, each of the plurality of outwardly extending tynes having at least one of the plurality of contact points;

the plurality of tabs extending radially from the socket and vertically along the socket;

the actuator having a blade, the blade moveable perpendicular to the center axis and positioned between the pair of curved ends, the blade having a stop notch and an open position and a closed position corresponding to the open position and the closed position of the socket contact, in the open position the stop notch mated with one of the curved ends;

the insulator openings having a plurality of tab openings, the plurality of tabs positioned in the plurality of tab openings; and the insulator positioned between the pair of ribs and the sockets and the socket contacts moveable in a z-direction relative to the insulator.

29. The circuit assembly of claim 25 wherein the package further comprises a thermal solution, the thermal solution attached to the package.

30. The circuit assembly of claim 29 wherein the thermal solution is fixedly attached to the package.

31. A method of electrically connecting a pin and a socket assembly comprising:

providing a pin and providing a socket assembly having a socket and a socket contact, the socket having a substantially central axis and a pair of ribs circumscribing the socket;

opening the socket contact in a direction away from the substantially central axis of the socket;

inserting the pin into the socket;

closing the socket contact in a direction towards the pin;

contacting the pin with a plurality of contact points;

providing an actuator, wherein the actuator is outside the socket when the socket contact is closed; and moving the actuator relative to the pin and socket without moving the pin relative to the socket.

32. The method of claim 31 further comprising wiping the pin with the plurality of contact points.

33. The method of claim 31 further comprising moving the plurality of contact points vertically along the pin.

34. The method of claim 31 further comprising providing an insulator; and after closing the socket contact, floating the socket and socket contact in a z-direction relative to the insulator.

35. A method of providing an electrical connection comprising:

extending a plurality of electrical contacts to define a first opening having a diameter that is greater than the diameter of a conductive pin; and retracting the plurality of electrical contacts to define a second opening having a diameter that is less than the diameter of a conductive pin, such that the plurality of electrical contacts form a plurality of electrical contact points with the conductive pin when the conductive pin is inserted into the first opening, wherein the retracting is performed by inserting an actuator into a band opening, wherein a socket comprises the plurality of electrical contacts and a band having the band opening, wherein the actuator is separate from the band, wherein the socket has a pair of ribs circumscribing the socket.

36. The method of claim 35 further comprising inserting the conductive pin before retracting the plurality of electrical contacts.

* * * * *